US010964991B2

(12) United States Patent
Deleniv et al.

(10) Patent No.: US 10,964,991 B2
(45) Date of Patent: Mar. 30, 2021

(54) TUNABLE WAVEGUIDE FILTER INPUT/OUTPUT COUPLING ARRANGEMENT

(71) Applicant: Telefonaktiebolaget LM Ericsson (publ), Stockholm (SE)

(72) Inventors: Anatoli Deleniv, Mölndal (SE); Michael Perelshtein, L'Ile-Bizard (CA); Ove Persson, Hunnebostrand (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 6 days.

(21) Appl. No.: 16/482,926

(22) PCT Filed: Mar. 6, 2017

(86) PCT No.: PCT/EP2017/055182

§ 371 (c)(1),
(2) Date: Aug. 1, 2019

(87) PCT Pub. No.: WO2018/162032

PCT Pub. Date: Sep. 13, 2018

(65) Prior Publication Data

US 2020/0014085 A1 Jan. 9, 2020

(51) Int. Cl.
*H01P 1/209* (2006.01)
*H01P 7/06* (2006.01)

(52) U.S. Cl.
CPC ..... *H01P 1/209* (2013.01); *H01P 7/06* (2013.01)

(58) Field of Classification Search
CPC .. H01P 1/20; H01P 1/207; H01P 1/208; H01P 1/209; H01P 7/06; H01P 5/02; H01P 5/024; H01P 5/04
(Continued)

(56) References Cited

U.S. PATENT DOCUMENTS 2,897,457 A 7/1959 Marie
4,168,478 A 9/1979 Schuegraf
(Continued)

FOREIGN PATENT DOCUMENTS

EP 1 564 835 A1 8/2005
FR 2 382 108 A1 9/1978
GB 1 359 939 A 7/1974

OTHER PUBLICATIONS

International Search Report and Written Opinion of the International Searching Authority for International Application No. PCT/EP2017/055182 dated Nov. 15, 2017.
(Continued)

*Primary Examiner* — Rakesh B Patel
*Assistant Examiner* — Jorge L Salazar, Jr.
(74) *Attorney, Agent, or Firm* — Sage Patent Group

(57) ABSTRACT

The present disclosure relates to a tunable waveguide filter input/output coupling arrangement comprising a waveguide part, a coupling iris part and a tunable filter part. The waveguide part runs along a longitudinal extension and has a waveguide width extending perpendicular to the longitudinal extension, and is electrically connected to the tunable filter part by means of the coupling iris part which comprises an opening between the waveguide part and the tunable filter part. The opening is positioned at a certain position along the longitudinal extension. The waveguide part comprises a stub part that has a certain stub length along the longitudinal extension, between an electrical short-circuit end plate and an edge of the opening that is closest to the end plate, where the stub part also has a stub width extending perpendicular to the longitudinal extension.

19 Claims, 5 Drawing Sheets

(58) Field of Classification Search
USPC ..... 333/105, 106, 108, 254, 256, 258, 259
See application file for complete search history.

(56) References Cited

U.S. PATENT DOCUMENTS 4,812,790 A 3/1989 Tatomir et al.
9,819,067 B2 * 11/2017 Yang ..... H01P 5/08

OTHER PUBLICATIONS

Bryan et al., "A Wide-Band Nearly Constant Susceptance Waveguide Element," IEEE Transactions on Microwave Theory and Techniques, vol. MTT-19, No. 11, pp. 889-891, Nov. 1971.
Yassini et al., "A Ku-Band High-Q Tunable Filter With Stable Tuning Response," IEEE Transactions on Microwave Theory and Techniques, vol. 57, No. 12, pp. 2948-2957 Dec. 2009.

* cited by examiner

TUNABLE WAVEGUIDE FILTER INPUT/OUTPUT COUPLING ARRANGEMENT

CROSS REFERENCE TO RELATED APPLICATION

This application is a 35 U.S.C. § 371 national stage application of PCT International Application No. PCT/EP2017/055182, filed on Mar. 6, 2017, the disclosure of which is hereby incorporated herein by reference in its entirety.

TECHNICAL FIELD

The present disclosure relates to a tunable waveguide filter input/output coupling arrangement that comprises a waveguide part, a coupling iris part and a tunable filter part. The waveguide part runs along a longitudinal extension and is electrically connected to the tunable filter part by means of the coupling iris part.

BACKGROUND

In wireless communication networks there is radio equipment that in many cases comprises waveguide filters, and for some applications it is desirable to have one or more tunable waveguide filter such as for example short haul diplexers and similar. For a tunable waveguide filter it is further desired to have a bandwidth that is as constant as possible over the tunable range. Practical implementation of tunable waveguide filters with a nearly constant bandwidth is a major design challenge, especially if waveguide cavities are to be used.

Typically, inductive or capacitive irises are used to couple a resonator to another one or to a feeding waveguide. These demonstrate high dispersion properties leading to change in the fractional bandwidth as the filters are tuned. In most cases this undesirable effect limits the application of the tunable filter. One example is disclosed in the paper "A wide band nearly constant susceptance waveguide element", IEEE Trans. On Microwave Theory and Techniques, vol. MTT-19, No. 11, pp. 889-891, November 1971, by J. G. Bryan and F. J. Rosenbaun. The disclosed design using a metal non-contacting iris made of a thin rectangular metal strip mounted on a low-loss foam plastic block, is, however, complex in manufacturing since it requires additional substrate and also suffers from loss.

There is thus a need for a tunable waveguide filter with a nearly constant bandwidth that is less complicated and exhibits less loss than prior solutions.

SUMMARY

It is an object of the present disclosure to provide a tunable waveguide filter with a nearly constant bandwidth that is less complicated and exhibits less loss than prior solutions.

Said object is obtained by means of a tunable waveguide filter input/output coupling arrangement that comprises a waveguide part, a coupling iris part and a tunable filter part. The waveguide part runs along a longitudinal extension and has a waveguide width extending perpendicular to the longitudinal extension, and a waveguide height extending perpendicular to the waveguide width. The waveguide part is electrically connected to the tunable filter part by means of the coupling iris part which comprises an opening between the waveguide part and the tunable filter part, where the opening is positioned at a certain position along the longitudinal extension. The waveguide part comprises a stub part that has a certain stub length along the longitudinal extension, between an electrical short-circuit end plate and an edge of the opening that is closest to the end plate. The stub part also has a stub width extending perpendicular to the longitudinal extension.

This enables obtaining an increasing, a decreasing or a stable coupling over a relatively wide tuning range. The uncomplicated design further confers manufacturing advantages since it does not require any changes into currently used production technology for waveguide filters.

According to some aspects, the tunable filter part comprises a tunable resonance cavity that is arranged to be electrically connected to further resonance cavities by means of a corresponding cavity iris part.

This provides an advantage of flexibility, where the present disclosure is applicable for a broad range of microwave filters.

According to some aspects, the stub part has a stub width that to the most part either falls below the waveguide width, exceeds the waveguide width, or equals the waveguide width.

According to some aspects, the stub length varies between $\lambda/8$ and $\lambda/2$ where $\lambda$ denotes the wavelength in air that corresponds to the center frequency in a desired frequency band.

This provides an advantage of having easily controllable tuning parameters when choosing a suitable stub length and stub width.

Said object is also achieved by means of a microwave transceiver comprising a tunable waveguide filter input/output coupling arrangement that in turn comprises a waveguide part, a coupling iris part and a tunable filter part. The waveguide part runs along a longitudinal extension and has a waveguide width extending perpendicular to the longitudinal extension, and a waveguide height extending perpendicular to the waveguide width. The waveguide part is electrically connected to the tunable filter part by means of the coupling iris part which comprises an opening between the waveguide part and the tunable filter part, where the opening is positioned at a certain position along the longitudinal extension. The waveguide part comprises a stub part that has a certain stub length along the longitudinal extension, between an electrical short-circuit end plate and an edge of the opening that is closest to the end plate. The stub part also has a stub width extending perpendicular to the longitudinal extension.

A microwave transceiver is then provided, where the microwave transceiver comprises a tunable waveguide filter input/output coupling arrangement that is enabled to obtain an increasing, a decreasing or a stable coupling over a relatively wide tuning range. The uncomplicated design of the tunable waveguide filter input/output coupling arrangement further confers manufacturing advantages since it does not require any changes into currently used production technology for waveguide filters.

BRIEF DESCRIPTION OF THE DRAWINGS

The present disclosure will now be described more in detail with reference to the appended drawings, where.

DETAILED DESCRIPTION

Figure 1:
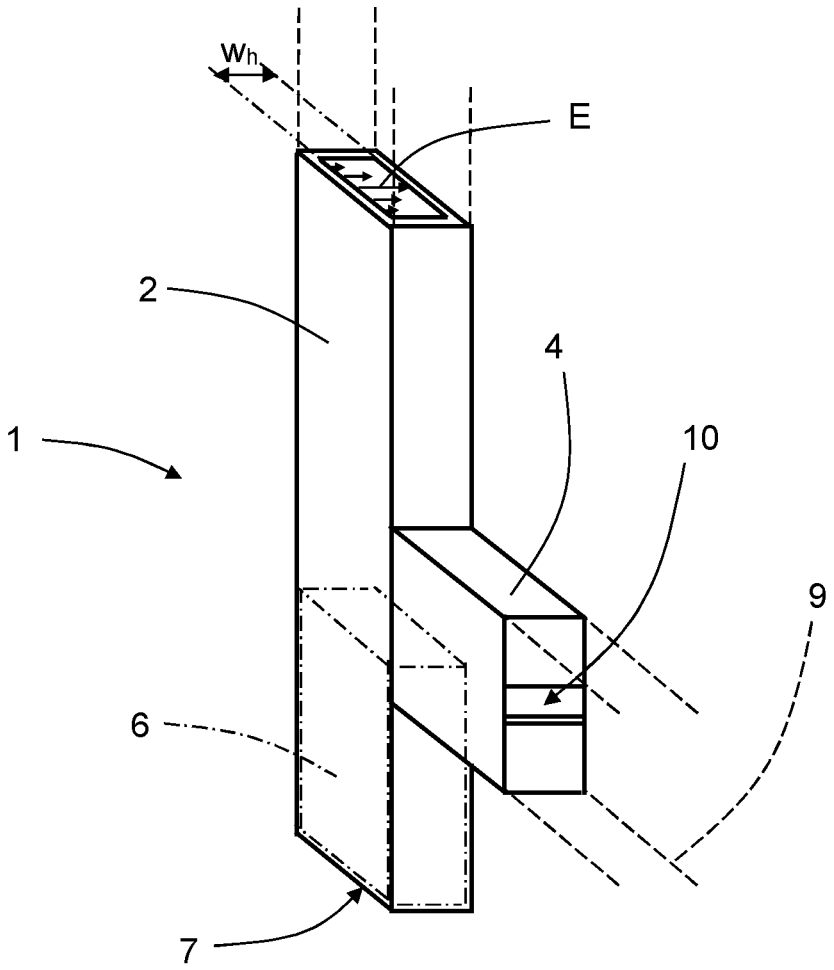
FIG. 1 shows a schematic perspective view of a tunable waveguide filter input/output coupling arrangement.
Figure 2:
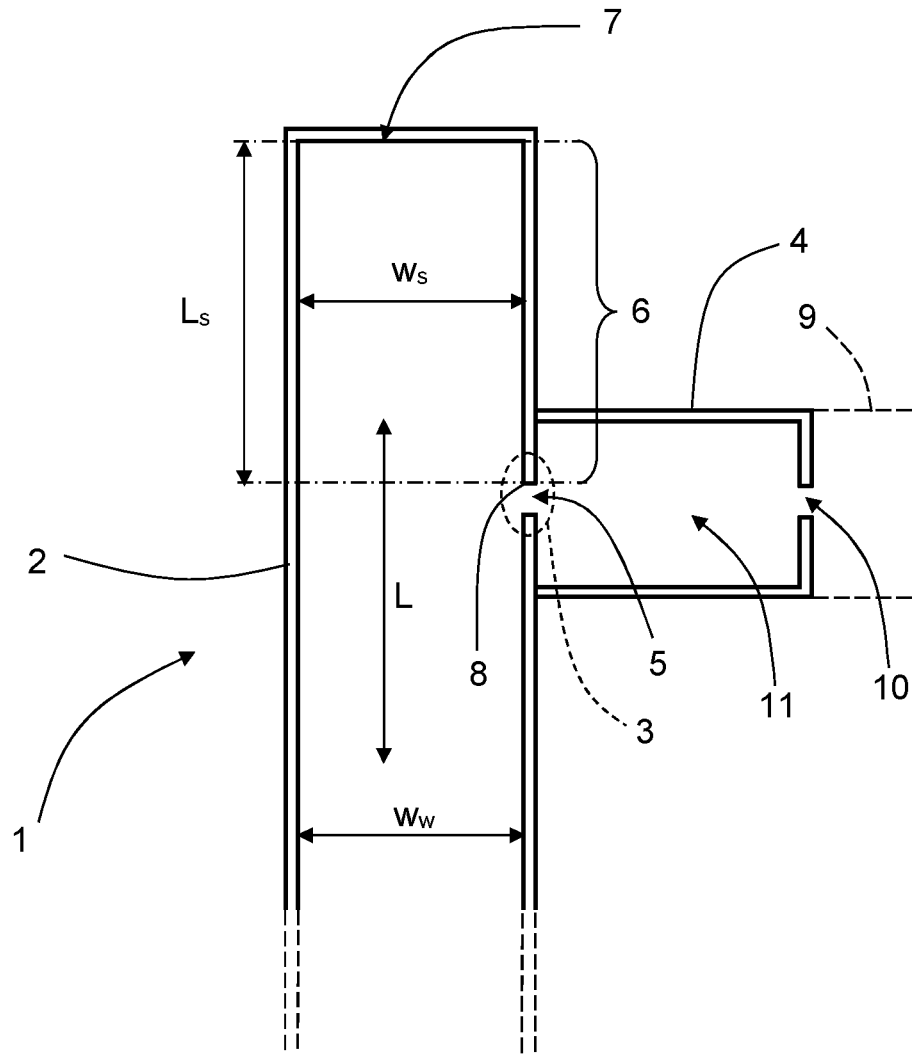
FIG. 2 shows a schematic top cut-open view of a first example of a tunable waveguide filter input/output coupling arrangement.

With reference to FIG. 1, showing a schematic perspective view of a tunable waveguide filter input/output coupling arrangement, and FIG. 2, showing a corresponding top cut-open view, a first example of a tunable waveguide filter input/output coupling arrangement 1 will now be described.

The tunable waveguide filter input/output coupling arrangement 1 comprises a waveguide part 2, a coupling iris part 3 and a tunable filter part 4. The waveguide part 2 runs along a longitudinal extension L and has a waveguide width $w_w$ extending perpendicular to the longitudinal extension L, and a waveguide height $w_h$ extending perpendicular to the waveguide width $w_w$. The waveguide part 2 is electrically connected to the tunable filter part 4 by means of the coupling iris part 3 which comprises an opening 5 between the waveguide part 2 and the tunable filter part 4, where the opening 5 is positioned at a certain position along the longitudinal extension L According to the present disclosure, the waveguide part 2 comprises a stub part 6 that has a certain stub length $L_s$ along the longitudinal extension L, between an electrical short-circuit end plate 7 and an edge 8 of the opening 5 that is closest to the end plate 7, where the stub part 6 also has a certain stub width $w_s$ extending perpendicular to the longitudinal extension L. In this example, the stub part 6 has a stub width $w_s$ that is equal to the waveguide width $w_w$.

According to some aspects, the tunable filter part 4 comprises at least one tunable resonance cavity 11. Generally, according to some further aspects, the tunable filter part 4 comprises a tunable resonance cavity 11 that is arranged to be electrically connected to further resonance cavities 9 by means of a corresponding cavity iris part 10. In FIG. 2, at least one further resonance cavity 9 is depicted with dashed lines; the tunable filter part 4 can according to some aspects comprise two or more further resonance cavities that are separated by a corresponding cavity iris parts in a previously well-known manner.

Figure 3:
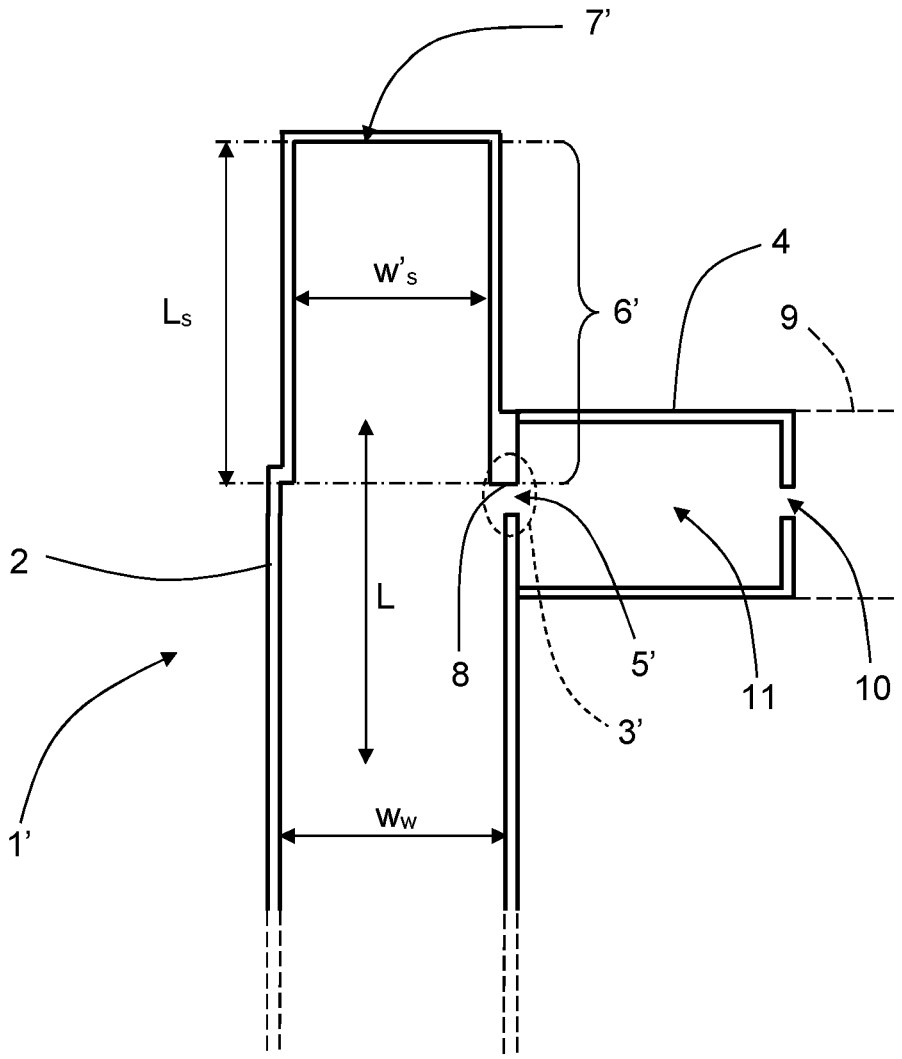
FIG. 3 shows a schematic top cut-open view of a second example of a tunable waveguide filter input/output coupling arrangement.

With reference to FIG. 3 that shows a schematic top cut-open view of a second example of a tunable waveguide filter input/output coupling arrangement 1', the stub part 6' has a stub width w's that falls below the waveguide width $w_w$.

Figure 4:
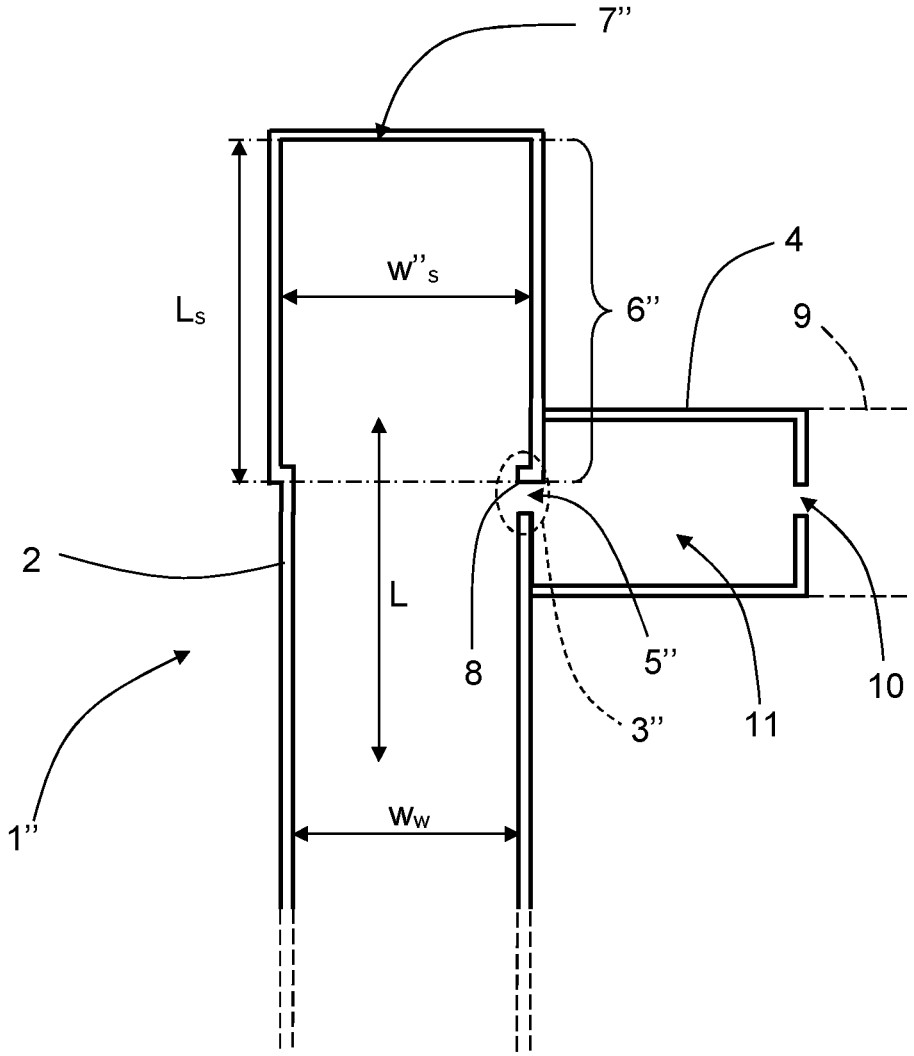
FIG. 4 shows a schematic top cut-open view of a third example of a tunable waveguide filter input/output coupling arrangement.

With reference to FIG. 4 that shows a schematic top cut-open view of a third example of a tunable waveguide filter input/output coupling arrangement 1", the stub part 6" has a stub width w"s that to the most part exceeds the waveguide width $w_w$.

According to some aspects, as shown in FIG. 2, FIG. 3 and FIG. 4, the stub width affects the design of other parts such as the coupling iris part 3, 3', 3", the opening 5, 5', 5" and the electrical short-circuit end plate 7, 7', 7".

By means of the present disclosure, with properly chosen dimensions of the stub width $w_s$ and stub length $L_s$, it is possible to achieve control of dispersion properties of the input/output couplings at the coupling iris part 3, and nearly dispersion-free coupling in a relatively wide frequency band is practically obtainable. In practice, this control of the dispersion properties enables obtaining a nearly constant coupling, as well as a controllable increasing/decreasing coupling, in a relatively wide tuning range.

By means of the present disclosure, manufacturing is not made more complicated, the tunable waveguide filter input/output coupling arrangement 1 does in fact not require any particular changes into currently used production technology for short haul diplexers or other types of waveguide filters.

According to some aspects, the stub length $L_s$ varies between $\lambda/8$ and $\lambda/2$ where $\lambda$ denotes the wavelength in air that corresponds to the center frequency in a desired frequency band.

Figure 5:
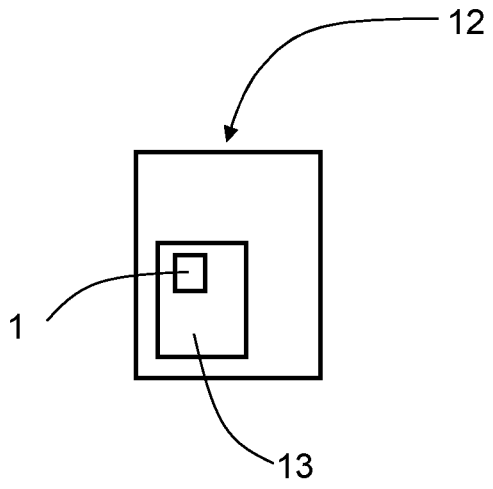
FIG. 5 shows a schematic view of a microwave transceiver.

With reference to FIG. 5, schematically showing a microwave transceiver 12, the microwave transceiver 12 comprises a waveguide filter device 13 that in turn comprises a tunable waveguide filter input/output coupling arrangement 1 according to the above. According to some aspects, the microwave transceiver 12 is used in a radio link device.

The present disclosure is not limited to the above, but may vary within the scope of the appended claims. For example, it is conceivable that the stub width varies in a continuous or stepped manner, at least along a part of the stub length $L_s$.

The waveguide part 2 is shown to have a continuation with dashed lines in all the Figures. The waveguide part 2 can according to some aspects continue in a bend, such as a 90° bend, or continue by being connected to another waveguide part.

The waveguide parts may be made in any suitable metal such as aluminum, or as a metal plating on a non-conducting material such as plastics. A metal plating can also be used to cover another metal totally or partially.

Generally, the present disclosure relates to a tunable waveguide filter input/output coupling arrangement 1 comprising a waveguide part 2, a coupling iris part 3 and a tunable filter part 4, where the waveguide part 2 runs along a longitudinal extension L and has a waveguide width $w_w$ extending perpendicular to the longitudinal extension L, and a waveguide height $w_h$ extending perpendicular to the waveguide width $w_w$, where the waveguide part 2 is electrically connected to the tunable filter part 4 by means of the coupling iris part 3 which comprises an opening 5 between the waveguide part 2 and the tunable filter part 4, where the opening 5 is positioned at a certain position along the longitudinal extension L. The waveguide part 2 comprises a stub part 6 that has a certain stub length $L_s$ along the longitudinal extension L, between an electrical short-circuit end plate 7 and an edge 8 of the opening 5 that is closest to the end plate 7, where the stub part 6 also has a stub width $w_s$ extending perpendicular to the longitudinal extension L.

According to some aspects, the tunable filter part 4 is constituted by a tunable resonance cavity that is arranged to be electrically connected to further resonance cavities 9 by means of a corresponding cavity iris part 10.

According to some aspects, the stub part 6', 6", 6 has a stub width $w'_s$ $w''_s$ $w_s$ that to the most part either:

falls below the waveguide width $w_w$;

exceeds the waveguide width $w_w$; or equals the waveguide width $w_w$.

According to some aspects, the stub length $L_s$ varies between $\lambda/8$ and $\lambda/2$ where $\lambda$ denotes the wavelength in air that corresponds to the center frequency in a desired frequency band.

Generally, the present disclosure also relates to a microwave transceiver 12 comprising a tunable waveguide filter input/output coupling arrangement 1 that in turn comprises a waveguide part 2, a coupling iris part 3 and a tunable filter part 4, where the waveguide part 2 runs along a longitudinal extension L and has a waveguide width $w_w$ extending perpendicular to the longitudinal extension L, and a waveguide height $w_h$ extending perpendicular to the waveguide width $w_w$, where the waveguide part 2 is electrically connected to the tunable filter part 4 by means of the coupling iris part 3 which comprises an opening 5 between the waveguide part 2 and the tunable filter part 4, where the opening 5 is positioned at a certain position along the longitudinal extension L. The waveguide part 2 comprises a stub part 6 that has a certain stub length $L_s$ along the longitudinal extension L, between an electrical short-circuit end plate 7 and an edge 8 of the opening 5 that is closest to the end plate 7, where the stub part 6 also has a stub width $w_s$ extending perpendicular to the longitudinal extension L.

The invention claimed is:

1. A tunable waveguide filter input/output coupling arrangement comprising:

a waveguide part that runs along a longitudinal extension, has a waveguide width extending perpendicular to the longitudinal extension, has a waveguide height extending perpendicular to the waveguide width, and is configured for a dominant transverse electric ("TE") mode;

a coupling iris part; and a tunable filter part electrically connected to the waveguide part by the coupling iris part, which comprises an opening between the waveguide part and the tunable filter part, the opening being positioned at a position along the longitudinal extension, wherein the waveguide part comprises a stub part that has a stub length along the longitudinal extension between an electrical short-circuit end plate and an edge of the opening that is closest to the electrical short-circuit end plate, and has a stub width extending perpendicular to the longitudinal extension.

2. The tunable waveguide filter input/output coupling arrangement of claim 1, wherein the tunable filter part comprises a tunable resonance cavity that is arranged to be electrically connected to further resonance cavities by a corresponding cavity iris part.

3. The tunable waveguide filter input/output coupling arrangement of claim 1, wherein the stub width equals the waveguide width.

4. The tunable waveguide filter input/output coupling arrangement of claim 1, wherein the stub length is set between λ/8 and λ/2, and wherein λ denotes a wavelength in air that corresponds to a center frequency in a desired frequency band.

5. The tunable waveguide filter input/output coupling arrangement of claim 1, wherein the stub width is less than the waveguide width.

6. The tunable waveguide filter input/output coupling arrangement of claim 1, wherein the stub width exceeds the waveguide width.

7. The tunable waveguide filter input/output coupling arrangement of claim 1, wherein the waveguide part is a rectangular waveguide part, and wherein the dominant TE mode comprises a dominant TE10 mode.

8. A microwave transceiver comprising:

a tunable waveguide filter input/output coupling arrangement that in turn comprises a waveguide part that runs along a longitudinal extension, has a waveguide width extending perpendicular to the longitudinal extension, has a waveguide height extending perpendicular to the waveguide width, and is configured for a dominant transverse electric ("TE") mode;

a coupling iris part; and a tunable filter part electrically connected to the waveguide part by the coupling iris part, which comprises an opening between the waveguide part and the tunable filter part, the opening being positioned at a position along the longitudinal extension, wherein the waveguide part comprises a stub part that has a stub length along the longitudinal extension between an electrical short-circuit end plate and an edge of the opening that is closest to the electrical short-circuit end plate, and has a stub width extending perpendicular to the longitudinal extension.

9. The microwave transceiver of claim 8, wherein the tunable filter part comprises a tunable resonance cavity that is arranged to be electrically connected to further resonance cavities by a corresponding cavity iris part.

10. The microwave transceiver of claim 8, wherein the stub width equals the waveguide width.

11. The microwave transceiver of claim 8, wherein the stub length is set between λ/8 and λ/2, and wherein λ denotes a wavelength in air that corresponds to a center frequency in a desired frequency band.

12. The microwave transceiver of claim 8, wherein the stub width is less than the waveguide width.

13. The microwave transceiver of claim 8, wherein the stub width exceeds the waveguide width.

14. The microwave transceiver of claim 8, wherein the waveguide part is a rectangular waveguide part, and wherein the dominant TE mode comprises a dominant TE10 mode.

15. A tunable waveguide filter input/output coupling arrangement comprising:

a waveguide part that runs along a longitudinal extension, has a waveguide width extending perpendicular to the longitudinal extension, and has a waveguide height extending perpendicular to the waveguide width;

a coupling iris part; and a tunable filter part electrically connected to the waveguide part by the coupling iris part, which comprises an opening between the waveguide part and the tunable filter part, the opening being positioned at a position along the longitudinal extension, wherein the waveguide part comprises a stub part that has a stub length along the longitudinal extension between an electrical short-circuit end plate and an edge of the opening that is closest to the electrical short-circuit end plate, and has a stub width extending perpendicular to the longitudinal extension that is different than the waveguide width.

16. The tunable waveguide filter input/output coupling arrangement of claim 15, wherein the tunable filter part comprises a tunable resonance cavity that is arranged to be electrically connected to further resonance cavities by a corresponding cavity iris part.

17. The tunable waveguide filter input/output coupling arrangement of claim 15, wherein the stub length is set between λ/8 and λ/2, and wherein λ denotes a wavelength in air that corresponds to a center frequency in a desired frequency band.

18. The tunable waveguide filter input/output coupling arrangement of claim 15, wherein the waveguide part is configured for a dominant transverse electric ("TE") mode.

19. The tunable waveguide filter input/output coupling arrangement of claim 18, wherein the waveguide part is a rectangular waveguide part, and wherein the dominant TE mode comprises a dominant TE10 mode.

* * * * *